US011649567B2

(12) United States Patent
Lehmann et al.

(10) Patent No.: US 11,649,567 B2
(45) Date of Patent: May 16, 2023

(54) METHOD FOR PRODUCING A MULTIFILAMENT YARN

(71) Applicant: FRAUNHOFER-GESELLSCHAFT ZUR FÖRDERUNG DER ANGEWANDTEN FORSCHUNG E. V., Munich (DE)

(72) Inventors: André Lehmann, Potsdam (DE); Evgueni Tarkhanov, Potsdam (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 184 days.

(21) Appl. No.: 16/099,707

(22) PCT Filed: May 11, 2016

(86) PCT No.: PCT/EP2016/060577
§ 371 (c)(1),
(2) Date: Nov. 8, 2018

(87) PCT Pub. No.: WO2017/194103
PCT Pub. Date: Nov. 16, 2017

(65) Prior Publication Data

US 2019/0186051 A1 Jun. 20, 2019

(51) Int. Cl.
*D01F 9/22* (2006.01)
*D01D 5/098* (2006.01)
(Continued)

(52) U.S. Cl.
CPC ..... *D01F 9/22* (2013.01); *D01D 5/098* (2013.01); *D01F 6/38* (2013.01); *D01D 5/08* (2013.01); *D01D 5/088* (2013.01)

(58) Field of Classification Search
CPC .. D01F 9/22; D01F 6/38; D01D 5/098; D01D 5/08; D01D 5/088
See application file for complete search history.

(56) References Cited

U.S. PATENT DOCUMENTS 3,107,152 A 10/1963 Ford et al.
3,803,286 A 4/1974 Nakatsuka et al.
(Continued)

FOREIGN PATENT DOCUMENTS

CA 1052064 A 4/1979
DE 102014219707 A1 3/2016
(Continued)

OTHER PUBLICATIONS

Bahl et al., "Manufacture of Carbon Fibers," Chapter 1, Carbon Fibers, 3rd edition Revised and Expanded, edited by Jean-Baptiste Donner et al., Marcel Dekker, Inc., New York, pp. 1-27 (1998).
(Continued)

*Primary Examiner* — Galen H Hauth
(74) *Attorney, Agent, or Firm* — Leydig, Voit & Mayer, Ltd.

(57) ABSTRACT

The present invention relates to a method for producing a multifilament yarn from a melt of a copolymer of polyacrylicnitrile. The method is characterized in that a multifilament yarn is produced by means of pressing a melt of a copolymer through a spinning nozzle and is subsequently stretched at least tenfold. The present invention further relates to a correspondingly produced multifilament yarn.

17 Claims, 1 Drawing Sheet

(51) Int. Cl.

| | |
|---|---|
| ***D01F 6/38*** | (2006.01) |
| ***D01D 5/088*** | (2006.01) |
| ***D01D 5/08*** | (2006.01) |

(56) References Cited

U.S. PATENT DOCUMENTS

| | | | | |
|---|---|---|---|---|
| 4,107,252 | A * | 8/1978 | Richmond | D01F 6/40 264/210.8 |
| 4,163,770 | A * | 8/1979 | Porosoff | D01D 5/08 264/210.3 |
| 4,237,256 | A * | 12/1980 | Kobashi | C08F 20/44 524/827 |
| 4,698,413 | A * | 10/1987 | Lynch | C08F 220/48 525/328.5 |
| 4,921,656 | A | 5/1990 | Daumit et al. | |
| 4,933,128 | A | 6/1990 | Daumit et al. | |
| 4,935,180 | A | 6/1990 | Daumit et al. | |
| 5,618,901 | A * | 4/1997 | Smierciak | C08F 220/44 526/342 |
| 6,114,034 | A * | 9/2000 | Jorkasky, II | D01F 6/18 428/364 |
| 9,920,456 | B2 | 3/2018 | Shinmen et al. | |
| 10,006,152 | B2 | 6/2018 | Lehmann et al. | |
| 10,233,569 | B2 | 3/2019 | Shinmen et al. | |
| 10,662,556 | B2 | 5/2020 | Shinmen et al. | |
| 2013/0295811 | A1 | 11/2013 | Shinmen et al. | |
| 2015/0037241 | A1 | 2/2015 | Lehmann et al. | |
| 2017/0275405 | A1 | 9/2017 | Hahn et al. | |
| 2017/0298539 | A1 | 10/2017 | Hahn et al. | |
| 2018/0155855 | A1 | 6/2018 | Shinmen et al. | |
| 2019/0513628 | | 5/2019 | Shinmen et al. | |
| 2020/0263327 | A1 | 8/2020 | Shinmen et al. | |

FOREIGN PATENT DOCUMENTS

| | | | |
|---|---|---|---|
| EP | 2 628 827 | A1 | 8/2013 |
| GB | 1 270 504 | A | 4/1972 |
| JP | S46-034939 | B1 | 10/1971 |
| JP | S50-017106 | B1 | 6/1975 |
| JP | S57-047283 | B2 | 10/1982 |
| JP | S59-029681 | B2 | 7/1984 |
| JP | S59-045762 | B2 | 11/1984 |
| JP | S62-062909 | A | 3/1987 |
| JP | S62-078209 | A | 4/1987 |
| JP | H01-111010 | A | 4/1989 |
| JP | H02-160911 | A | 6/1990 |
| JP | H02-160912 | A | 6/1990 |
| JP | H03-045708 | A | 2/1991 |
| JP | 2007-321267 | A | 12/2007 |
| JP | 2017-529464 | A | 10/2017 |
| WO | WO 2012/050171 | A1 | 4/2012 |
| WO | WO 216/050478 | A1 | 4/2016 |
| WO | WO 2016/050479 | A1 | 4/2016 |

OTHER PUBLICATIONS

European Patent Office, International Search Report in International Application No. PCT/EP2016/060577 (dated Feb. 9, 2017).
European Patent Office, Written Opinion in International Application No. PCT/EP2016/060577 (dated Feb. 9, 2017).
International Bureau of WIPO, International Preliminary Report on Patentability in International Application No. PCT/EP2016/060577 (dated Nov. 13, 2018).
European Patent Office, Notification under Article 94 (3) EPC in European Patent Application No. 16 723 074.7 (dated Aug. 23, 2019).
Stark et al., "Zum Einfluß von Düsenverzug und plastischer Reckung auf die Eigenschaften von naßgesponnenen Polyoxadiazolfäden," (Effect of jet draw rate and plastic drawing on the properties of wet spun polyoxadiazole fibres) *Acta Polymer* 43: 159-164 (1992).
Japan Patent Office, Notification of Reasons for Refusal in Japanese Patent Application No. 2018-559393 (dated Feb. 26, 2020).
Japan Patent Office, Response to Notification of Reasons for Refusal and Written Correction of Mistranslation in Japanese Patent Application No. 2018-559393 (dated Aug. 27, 2020).
Japan Patent Office, Decision to Grant a Patent in Japanese Patent Application No. 2018-559393 (dated Sep. 23, 2020).
U.S. Appl. No. 14/118,480, filed Nov. 18, 2013.
U.S. Appl. No. 16/072,514, filed Jul. 25, 2018.

* cited by examiner

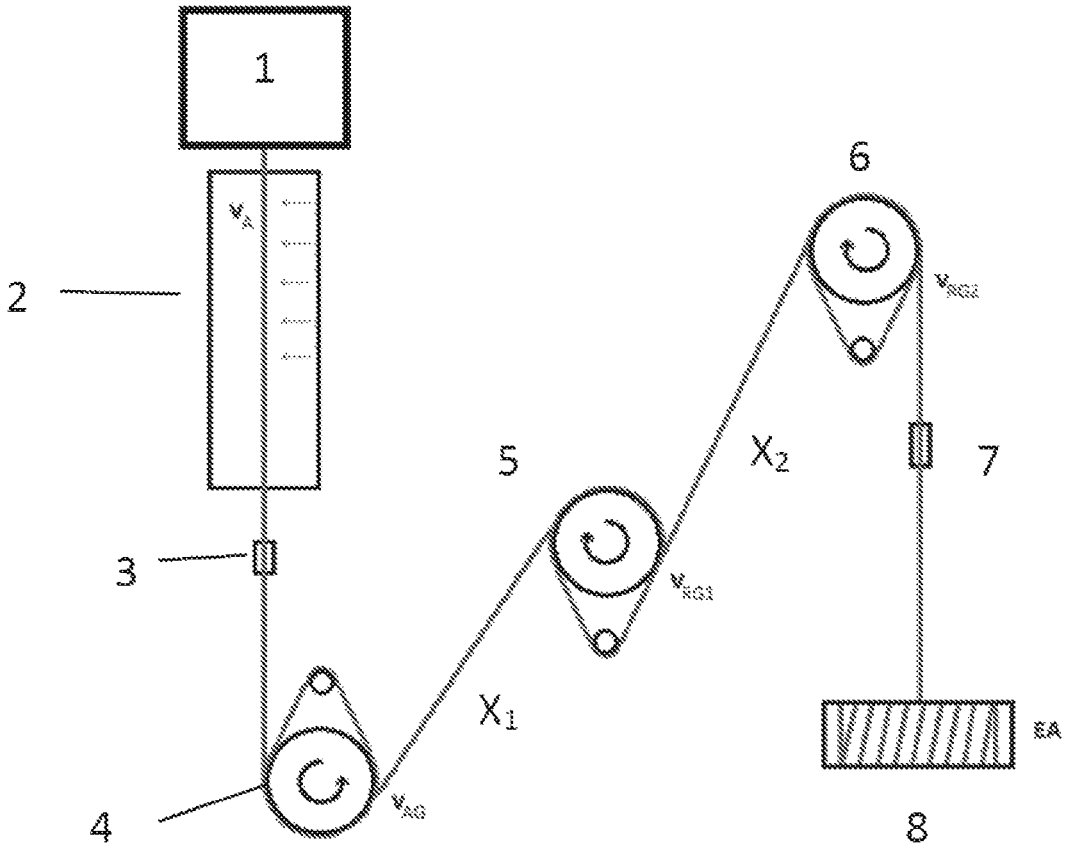
1
2
3
4
5
6
7
8
X1
X2
EA

METHOD FOR PRODUCING A MULTIFILAMENT YARN

CROSS-REFERENCE TO A RELATED APPLICATION

This patent application is the U.S. national phase of International Application No. PCT/EP2016/060577, filed on May 11, 2016, the disclosure of which is incorporated herein by reference in its entirety for all purposes.

The present invention relates to a method for producing a multifilament yarn from a melt of a copolymer of polyacrylonitrile. The method is characterized by a multifilament yarn being produced by pressing a melt of a copolymer through a spinneret and subsequently being stretched by at least the tenfold. The present invention relates in addition to a correspondingly produced multifilament yarn.

The industrial production and also marketing of carbon fibres began in 1963. At that time, C. E. Ford and C. V. Mitchell of Union Carbide developed and patented a continuous method for producing carbon fibres based on cellulose precursors [Ford C E, Mitchell C V, U.S. Pat. No. 3,107,152, 1963]. Already by 1964, carbon fibres with the trade name "Thornel 25" with strengths of 1.25 GPa and moduli of 172 GPa had been introduced onto the market. Later, the brands "Thornel 50", "Thornel 75" and "Thornel 100" followed. The last-mentioned carbon fibres were characterised by strengths of 4.0 GPa and moduli of 690 GPa.

The outstanding property profile could be achieved exclusively only by a special process control. The cellulose fibres were subjected to temperatures of 2,500-3,000° C. and were thereby deformed (stretch graphitisation). Only at these high temperatures can graphite be deformed plastically and orientated along the fibre axis and consequently can competitive fibre properties be achieved.

However, the production process was costly (up to 1000$/kg of carbon fibre) and uneconomical (carbon yield only 10-20% by weight), such that, in 1978, production of carbon fibres on the basis of cellulose precursors was discontinued almost completely and presently they exist only for niche applications. The demise of the cellulose-based carbon fibre is closely associated with the development of PAN (polyacrylonitrile)-based carbon fibres which allow significantly higher carbon yields with the same property profile.

At present, polyacrylonitrile (PAN) or copolymers of polyacrylonitrile are the dominating polymers as starting material for producing precursor filament yarns (>95%) and carbon fibres produced therefrom. The large bandwidth of ex-PAN carbon fibres is completed by the ultrahigh-modulus pitch-based carbon fibres. An overview of production capacities, the chemical and physical structure and also the mechanical properties and applications of such carbon fibres is given in J. P. Donnet et al., Carbon fibers, third edition, Marcel Dekker, Inc. New York, Basle, Hong Kong.

As explained in DE 10 2014 219 707, acrylic precursor fibres have been produced to date exclusively via wet- or dry-spinning methods. For this purpose, a solution of polymers with concentrations 20% is spun either in a coagulation bath or a hot steam atmosphere, the solvent diffusing out of the fibre. In this way, qualitatively high-value precursors are produced, however the costs of the methods are comparatively high. This results, on the one hand, from the necessary solvents and handling thereof, on the other hand, from the relatively low throughput in solvent spinning methods.

As was shown in DE 10 2014 219 707, it became possible for melt-spinnable copolymers of polyacrylonitrile (PAN) to be synthesised by a copolymerisation of acrylonitrile with an alkoxyalkylacrylate and likewise to shape these continuously from the melt to form monofilaments. This demonstrates the basic processibility of the claimed polymers from the melt. The thereby produced titres of the displayed monofilaments are >1 tex. This filament titre is too high for conversion of the precursor since the diffusion path for the occurring gaseous cleavage product from the filament, during the thermal treatment of the precursor, for stabilising and carbonising the latter, is too long. This results in an increasing inner pressure in the filament and leads unavoidably to defects which do not allow continuous conversion at all or only into significantly low textile-physical properties of the resulting carbon fibre. Lowering the filament titre is therefore indispensable. In order to make this possible, a multifilament spinning process for the copolymers of polyacrylonitrile described in DE 10 2014 219 707 was developed.

Hence, it is the object of the present invention to indicate a method for producing a multifilament yarn with which the filament titre of multifilament yarns can be cut, i.e. reduced. In addition, the corresponding multifilament yarns are intended to have as high a stability as possible. In addition, it is the object of the present invention to mention corresponding multifilament yarns.

This object is achieved by the features of the method for producing a multifilament yarn and the multifilament yarn described herein, and the advantageous developments thereof.

Hence, the invention relates to a method for producing a multifilament yarn in which a melt of a copolymer of polyacrylonitrile (PAN), producible by a copolymerisation of 95 to 60% by mol of acrylonitrile with at least one comonomer selected from a) 5 to 20% by mol of at least one alkoxyalkylacrylate of the general formula I, Formula I

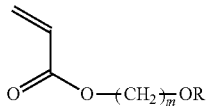

with $R=C_nH_{2n+1}$ and n=1–8 and m=1–8, in particular n=1–4 and m=1–4, b) 0 to 10% by mol of at least one alkylacrylate of the general formula II Formula II

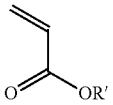

with $R'=C_nH_{2n+1}$ and n=1–18, and c) 0 to 10% by mol of at least one vinyl ester of the general formula III Formula III

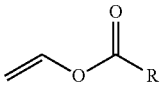

with $R=C_nH_{2n+1}$ and n=1–18, is spun in a melt spinning method by means of extrusion of a melt of the copolymer through a spinneret which has a plurality of spinning holes to form a multifilament yarn, and the multifilament yarn is stretched by at least the 10-fold.

In the case of the method according to the invention, a melt of the previously mentioned copolymer is hence pressed through a spinneret. The spinneret thereby has a large number of spinning holes, hence, during extrusion of the melt of the copolymer through the spinneret, a number of individual filaments corresponding to the number of spinning holes is produced. The corresponding individual filaments are bundled to form the multifilament yarn. The multifilament yarn is subsequently stretched.

According to a preferred embodiment, the multifilament yarn is stretched by the at least 20-fold, preferably by the 25- to 1,000-fold, in particular by the 150- to 400-fold.

A further preferred embodiment of the method provides that the multifilament yarn is cooled before or during the stretching. The cooling can thereby be effected such that the formed multifilament yarn is supplied with gases, in particular air. The gas is thereby temperature-controlled to preferably temperatures of −50 to +50° C., in particular to temperatures of 0 to 25° C.

There is termed thereby by stretching, the first lengthening of the multifilament yarn after its formation.

After the stretching, an additional lengthening of the multifilament yarn can be effected, this is hereby called drawing. Preferably, the drawing is effected by the at least 1.1- to 10-fold, preferably by the 1.1- to 6-fold of the length of the multifilament yarn before the drawing process.

Both stretching or drawing can be effected by means of galettes, in particular heated galettes, in this case the temperatures of such galettes are set to at least 50° C., preferably 50 to 150° C., in particular 55 to 90° C.

According to a further preferred embodiment, it is provided that the multifilament yarn is drawn off the spinneret with a nozzle drawing of <3,000, preferably <1,500 to 10, particularly preferably <500 to 30.

This embodiment relates to the individual filaments from which the multifilament is formed. The drawing is thereby based on the respective individual filaments immediately after exit from the nozzle.

It is of particular advantage in the present invention that stretching of the multifilament can be effected such that an orientation degree of the crystalline regions in the individual filaments forming the multifilament of ≥0.7, preferably of 0.75 to 0.95, particularly preferably of 0.8 to 0.9, results.

By means of this measure, the mechanical strength of the multifilament yarn can hence be further increased.

Furthermore, it is possible that the spinneret is set to a temperature which is at least 10 K above the temperature of the melt of the copolymer, preferably to a temperature of 10 to 80 K, in particular 15 to 45 K, above the temperature of the melt of the copolymer.

The melt of the copolymer can be set to a temperature of 120 to 300° C., preferably 150 to 230° C. and/or a zero shear viscosity (determined by means of a rheometer HAAKE RS 150 with plate-cone (1°) arrangement with a diameter of the measuring geometries of 20 mm and a gap opening of 0.052 mm) of <5,000 Pa·s, preferably 500 to 3,000 Pa·s, particularly preferably 1,000 to 1,500 Pa·s.

In addition, it is advantageous if the individual filaments and/or the multifilament yarn formed from the individual filaments is cooled with a cooling medium, preferably a gaseous cooling medium, in particular air, nitrogen or argon, the cooling medium preferably having a temperature which is at least 10° C. below the temperature of the melt of the copolymer, preferably temperatures being in the range of 10 to 200, particularly preferably of 15 to 80.

The multifilament yarn can thereby be drawn off at a final drawing speed of at least 300 m/min, preferably at least 500 to 5,000 m/min, in particular 750 to 2,000 m/min. The final withdrawal speed thereby denotes the speed at which the multifilament yarn is ultimately wound onto a roll.

The multifilament yarn can thereby be formed from 50 to 5,000 individual filaments, preferably 500 to 4,000 individual filaments, in particular 1,000 to 3,000 individual filaments.

Preferably, the individual filaments forming the basis of the multifilament are set to a fineness of <10 dtex, preferably of 0.01 to 10 dtex, particularly preferably 0.1 to 5 dtex.

The spinning holes can have a round, oval, Y-shaped, star-shaped or n-angled geometry with 8≥n≥3 and/or a ratio of length to diameter of 1:20, preferably 2:8.

The diameter of the spinnerets is preferably in the range of 10 to 1,000 μm, preferably 50 to 750 μm, particularly preferably 100 to 500 μm.

In particular, it is advantageous if no dimethlyacetamide, dimethylsulphoxide and/or water is added to the melt of the copolymer as plasticising agent, in particular no plasticising agent at all.

For further preference, the copolymer has a weight-average molar mass (Mw) in the range of 10,000 to 150,000 g/mol, preferably 15,000 to 80,000 g/mol.

According to a particularly preferred embodiment, the copolymer has 90 to 78% by mol of acrylonitrile, 8 to 12% by mol of the comonomer a), 1 to 5% by mol of the comonomer b) and/or 1 to 5% by mol of the comonomer c).

In addition, the invention relates to a multifilament yarn, consisting of a plurality of individual filaments made from one of a copolymer of polyacrylonitrile (PAN), producible by a copolymerisation of 95 to 80% by mol of acrylonitrile with at least one copolymer selected from a) 5 to 20% by mol of at least one alkoxyalkylacrylate of the general formula I, Formula I

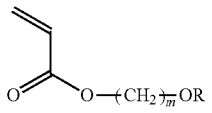

with $R=C_nH_{2n+1}$ and n=1–8 and m=1–8, in particular n=1–4 and m=1–4, b) 0 to 10% by mol of at least one alkylacrylate of the general formula II Formula II

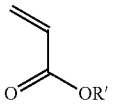

with $R'=C_nH_{2n+1}$ and n=1–18, and c) 0 to 10% by mol of at least one vinyl ester of the general formula III Formula III

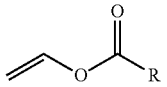

with $R=C_nH_{2n+1}$ and n=1–18, characterised by an orientation degree of the crystalline regions in the individual filaments of ≥0.7, preferably of 0.75 to 0.95, particularly preferably of 0.8 to 0.9.

The multifilament yarn, according to a preferred embodiment, is made of 50 to 5,000 individual filaments, preferably 500 to 4,000 individual filaments, in particular 1,000 to 3,000 individual filaments.

A further preferred embodiment of the multifilament yarn according to the present invention provides that the individual filaments forming the basis of the multifilament yarn have a fineness of <10 dtex, preferably of 0.01 to 10 dtex, particularly preferably 0.1 to 5 dtex.

For example, the method according to the invention can be configured such that the dried granulate is melted successively by means of a 1-screw extruder (L/D 25), is supplied to the gear pump, the constant volume flow of melt is conveyed through the spinneret and the emerging filaments are cooled by means of a gas and stretched by a multiple in the subsequent drawing frame by means of temperature-controllable galettes in order to achieve individual filament titres of <3 dtex. The addition of water or solvent is thereby entirely dispensed with.

The multifilament yarn according to the present invention is producible in particular according to a method according to the invention as described in the foregoing.

The present invention is explained in more detail with reference to the subsequent embodiments, given by way of example, without restricting the invention hereto.

EXAMPLE 1

The dried (vacuum 60° C./24 h) copolymer of PAN with a composition of 6.5% by mol of methoxyethylacrylate and 93.5% by mol of acrylonitrile and an average molar mass Mw of 43,000 g/mol and a PDI of 1.3 was metered into a 1-screw extruder (L/D 25). In order to avoid agglutinations, the feed was cooled and subsequently the temperature in the zones of the extruder was increased from 150° C. up to 235° C. The produced melt of the PAN copolymer was conveyed, by means of a gear pump, constantly through a 32 hole spinneret with round hole geometry, an L/D of 6 and also a hole diameter of 300 μm. The emerging filaments were cooled by means of a blowing pipe and the nozzle drawing of 98 was achieved by means of a take-down galette. On the subsequently connected drawing galettes, a drawing degree of 1.6 could be achieved before the produced multifilament yarn was wound continuously onto a bobbin by means of a bobbin head.

The individual filament titre was 2.9 dtex and the filament had a strength of 20.3 cN/tex, a modulus of elasticity of 653 cN/tex and a breaking elongation of 19.7%. The orientation degree of the crystalline phase determined by means of WAXS was 0.82.

EXAMPLE 2

The dried (vacuum 60° C./24 h) copolymer of PAN with a composition of 9.5% by mol of methoxyethylacrylate and 90.5% by mol of acrylonitrile and an average molar mass Mw of 55,000 g/mol and a PDI of 1.2 was metered into a 1-screw extruder (L/D 25). The process was as in example 1, the final spinning temperature, in contrast to example 1, was 220° C. It was conveyed through a 70 hole spinneret with an L/D of 4 and round hole geometry (d=200 μm). The emerging filaments were cooled by means of a blowing pipe and the nozzle drawing of 82 was achieved by means of a take-down galette. On the subsequently connected drawing galettes, a maximum drawing degree of 2.1 with a galette temperature of 85° C. could be achieved before the produced multifilament yarn was wound continuously onto a bobbin at a speed of 1,500 m/min by means of a bobbin head.

The filament has a circular cross-section and the individual filament titre was 2.1 dtex and the filament had a strength of 37.3 cN/tex, a modulus of elasticity of 853 cN/tex and also a breaking elongation of 13.7%, the orientation degree of the crystalline phase determined by means of WAXS was 0.85.

EXAMPLE 3

The dried (vacuum 60° C./24 h) copolymer of PAN with a composition of 9.3% by mol of methoxyethylacrylate and 90.7% by mol of acrylonitrile and an average molar mass Mw of 85,000 g/mol and a PDI of 1.2 was metered into a 1-screw extruder (L/D 25). The process was as in example 1, the final spinning temperature, in contrast to example 1, was 220° C. It was conveyed through a 70 hole spinneret with an L/D of 4 and round hole geometry (d=350 μm). The emerging filaments were cooled by means of a blowing pipe and the nozzle drawing of 527 was achieved by means of a take-down galette. On the subsequently connected drawing galettes, a drawing degree of 1.5 at a temperature of 95° C. could be achieved before the produced multifilament yarn was wound continuously onto a bobbin at a speed of 1,800 m/min by means of a bobbin head.

The filament has a circular cross-section and the individual filament titre was 1.6 dtex and the filament had a strength of 45.4 cN/tex, a modulus of elasticity of 920 cN/tex and also a breaking elongation of 11.8%. The orientation degree of the crystalline phase determined by means of WAXS was 0.88.

EXAMPLE 4

The multifilament made of copolymer of PAN which was produced in example 3 and wound onto a bobbin was subjected by means of electron beams to a radiation dose of 300 kGy. In contract to the sample of the multifilament yarn not treated with electron beams, the precursor yarn treated with an electron beam shows no more melting up to a temperature of 400° C.

The present invention is described in more detail with reference to the appended FIGURE.

The FIGURE shows an apparatus, by way of an example, for implementing a method according to the invention. With this apparatus, the multifilament yarns according to the invention can likewise be produced.

A melt of the copolymer is extruded through a spinneret 1 with a multiplicity of nozzle holes. The emerging individual filaments are thereby bundled to form a multifilament yarn. The resulting multifilament yarn is withdrawn via a take-down galette 4 through a cooling channel 2 at a withdrawal speed $v_w$. At 3, an optional further preparation of the multifilament yarn can be effected. In the cooling channel 2, the multifilament yarn is supplied with cooling air (illustrated by arrows). Via the take-down galette 4, the stretching of the multifilament yarn can be adjusted.

By means of subsequent drawing galettes 5 and 6, respectively a drawing factor $x_1$ or $x_2$ between the galettes 4 and 5 or 5 and 6 can be effected. The multifilament yarn is hence drawn even further between the galettes 4 and 5 and 5 and 6. The tension present on the multifilament yarn can be monitored by means of a tension sensor 7. Finally, the obtained multifilament yarn is wound onto a bobbin 8.

The invention claimed is:

1. A method for producing a multifilament yarn in which a melt of a copolymer of polyacrylonitrile (PAN), producible by a copolymerisation of 95 to 60% by mol of acrylonitrile with a) 5 to 20% by mol of at least one alkoxyalkylacrylate of the general formula I, Formula I

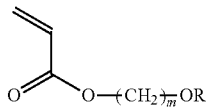

with $R=C_nH_{2n+1}$ and n=1-8 and m=1-8, b) 0 to 10% by mol of at least one alkylacrylate of the general formula II Formula II

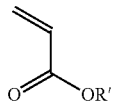

with $R'=C_nH_{2n+1}$ and n=1-18, and c) 0 to 10% by mol of at least one vinyl ester of the general formula III Formula III

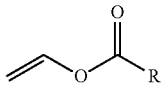

with $R=C_nH_{2n+1}$ and n=1-18, is spun in a melt spinning method by extruding a melt of the copolymer, wherein the melt of the copolymer is free of plasticising agents, through a spinneret which has a plurality of spinning holes to form a multifilament yarn and the multifilament yarn is stretched at least tenfold; and wherein the multifilament yarn is drawn off at a final drawing speed of at least 300 m/min;

wherein the multifilament yarn comprises 50 to 5,000 individual filaments; or wherein the individual filaments forming the basis of the multifilament are set to a fineness of <10 dtex.

2. The method according to claim 1, wherein the multifilament yarn is stretched at least 20-fold.

3. The method according to claim 1, wherein the multifilament yarn is cooled before and/or during the stretching.

4. The method according to claim 1, wherein the formed multifilament yarn is drawn after the stretching.

5. The method according to claim 1, wherein the stretching and/or the drawing is effected by heated galettes, which are set to temperatures of at least 50° C.

6. The method according to claim 1, wherein the multifilament yarn is drawn off the spinneret with a nozzle drawing of <3,000.

7. The method according to claim 1, wherein stretching of the multifilament yarn is effected such that an orientation degree of the crystalline regions in the individual filaments forming the multifilament of ≥0.7 results.

8. The method according to claim 1, wherein the spinneret is at a temperature which is at least 10 K above the temperature of the melt of the copolymer.

9. The method according to claim 1, wherein the melt of the copolymer is set to a temperature of 120 to 300° C., and/or a zero shear viscosity, determined by a rheometer HAAKE RS 150 with plate-cone (1°) arrangement with a diameter of the measuring geometries of 20 mm and a gap opening of 0.052 mm, of <5,000 Pa·s.

10. The method according to claim 1, wherein the individual filaments and/or the multifilament yarn formed from the individual filaments is cooled with a cooling medium.

11. The method according to claim 1, wherein the multifilament yarn is drawn off at a final drawing speed of 500 to 5,000 m/min.

12. The method according to claim 1, wherein the multifilament yarn comprises 500 to 4,000 individual filaments.

13. The method according to claim 1, wherein the individual filaments forming the basis of the multifilament are set to a fineness of 0.01 to 10 dtex.

14. The method according to claim 1, wherein the spinning holes have a round, oval, Y-shaped, star-shaped or n-angled geometry with 8≥n≥3 and/or a ratio of length to diameter of 1 to 20.

15. The method according to claim 1, wherein the diameter of the spinnerets is in the range of 10 to 1,000 μm.

16. The method according to claim 1, wherein the copolymer has a weight-average molar mass (Mw) in the range of 10,000 to 150,000 g/mol.

17. The method according to claim 1, wherein the copolymer has 90 to 78% by mol of acrylonitrile, 8 to 12% by mol of the comonomer a), 1 to 5% by mol of the comonomer b) and/or 1 to 5% by mol of the comonomer c).

* * * * *